US007913423B2

(12) United States Patent
Johnson et al.

(10) Patent No.: US 7,913,423 B2
(45) Date of Patent: Mar. 29, 2011

(54) ERGONOMIC INSOLE

(75) Inventors: Robert E. Johnson, Hendersonville, TN (US); Paul R. Johnson, Brentwood, TN (US)

(73) Assignee: Johnson Technologies Corporation, Nashville, TN (US)

( * ) Notice: Subject to any disclaimer, the term of this patent is extended or adjusted under 35 U.S.C. 154(b) by 476 days.

(21) Appl. No.: 11/355,319

(22) Filed: Feb. 14, 2006

(65) Prior Publication Data

US 2006/0191166 A1 Aug. 31, 2006

Related U.S. Application Data

(60) Provisional application No. 60/652,802, filed on Feb. 14, 2005, provisional application No. 60/661,897, filed on Mar. 15, 2005.

(51) Int. Cl.
*A43B 13/38* (2006.01)

(52) U.S. Cl. ..... 36/44; 36/43; 36/28; 36/88

(58) Field of Classification Search ..... 36/43, 44, 36/88, 28

See application file for complete search history.

(56) References Cited

U.S. PATENT DOCUMENTS 3,905,135 A * 9/1975 Debusk ..... 36/110
3,914,881 A * 10/1975 Striegel ..... 36/44
4,167,824 A * 9/1979 Wolpa ..... 36/44
4,232,457 A 11/1980 Mosher
4,267,728 A 5/1981 Manley et al.
4,285,144 A * 8/1981 Power ..... 36/44
4,517,696 A 5/1985 Schartz
4,642,912 A * 2/1987 Wildman et al. ..... 36/44
4,814,661 A 3/1989 Ratzlaff et al.
4,858,621 A 8/1989 Franks
4,897,935 A * 2/1990 Fel ..... 36/7.7
5,088,503 A 2/1992 Seitz
5,128,880 A 7/1992 White
5,195,945 A 3/1993 Sandvig et al.
5,233,769 A * 8/1993 Weber ..... 36/44
5,299,454 A 4/1994 Fuglewicz et al.
5,319,867 A * 6/1994 Weber ..... 36/44
5,471,405 A 11/1995 Marsh
5,502,536 A 3/1996 Amanuma et al.
5,623,944 A 4/1997 Nashner
5,678,448 A 10/1997 Fullen et al.
5,722,287 A 3/1998 Forstein
RE35,905 E * 9/1998 Vincent et al. ..... 12/142 P
5,813,142 A 9/1998 Demon
5,885,229 A 3/1999 Yamato et al.
5,941,835 A 8/1999 Sundman
5,957,870 A 9/1999 Yamato et al.
6,183,425 B1 2/2001 Whalen et al.

(Continued)

OTHER PUBLICATIONS http://www.rubberlite.com/hypurcel/introduction.php.*

*Primary Examiner* — Marie Patterson
(74) *Attorney, Agent, or Firm* — Carrithers Law Office, PLLC; David W. Carrithers; William R. Martin

(57) ABSTRACT

The present invention provides individual solutions to workplace fatigue and stress by determining the specific support needed for each individual. Specifically, the present invention defines and utilizes an ergonomic interaction factor to enable selection of a proper fitting shoe. Such selection occurs in one embodiment by dividing a person's weight by the contact area of the bottom of their feet.

24 Claims, 3 Drawing Sheets

U.S. PATENT DOCUMENTS

| | | | | |
|---|---|---|---|---|
| 6,186,000 | B1 | 2/2001 | Kaneko et al. | |
| 6,195,921 | B1 | 3/2001 | Truong | |
| 6,199,304 | B1 * | 3/2001 | Ludemann | 36/44 |
| 6,231,527 | B1 | 5/2001 | Sol | |
| 6,331,893 | B1 | 12/2001 | Brown et al. | |
| 6,360,598 | B1 | 3/2002 | Calame et al. | |
| 6,613,811 | B1 * | 9/2003 | Pallaver et al. | 521/81 |
| 6,823,550 | B2 | 11/2004 | Kantro | |
| 2002/0050080 | A1 * | 5/2002 | Vasyli | 36/145 |
| 2003/0087976 | A1 * | 5/2003 | Bambara et al. | 521/144 |
| 2003/0088999 | A1 * | 5/2003 | Ailey et al. | 36/44 |
| 2004/0045195 | A1 * | 3/2004 | Long et al. | 36/88 |
| 2004/0143452 | A1 | 7/2004 | Pattillo et al. | |
| 2005/0066545 | A1 * | 3/2005 | Peoples | 36/43 |
| 2005/0138847 | A1 * | 6/2005 | Blackburn et al. | 36/73 |
| 2005/0171456 | A1 | 8/2005 | Hirschman et al. | |
| 2005/0261609 | A1 | 11/2005 | Collings et al. | |
| 2006/0053657 | A1 * | 3/2006 | Ailey et al. | 36/44 |
| 2006/0213087 | A1 * | 9/2006 | Gallegos | 36/97 |
| 2007/0082189 | A1 * | 4/2007 | Gillette | 428/304.4 |

* cited by examiner

ERGONOMIC INSOLE

CROSS-REFERENCE TO RELATED APPLICATIONS

This application claims the benefit of priority under 35 U.S.C. §119(e) to U.S. Provisional Patent Application Nos. 60/652,802 filed Feb. 14, 2005 and 60/661,897 filed Mar. 15, 2005. This application further claims benefit under 35 U.S.C. §120 to U.S. patent application Ser. No. 11/337,803 filed Jan. 24, 2006, which claims priority under 35 U.S.C. §119(e) to U.S. Provisional Patent Application No. 60/645,619, filed Jan. 24, 2005.

BACKGROUND OF THE INVENTION

According to occupational therapy doctors, a person standing at a static or limited range position at a workstation for prolonged periods of time may have significant cumulative trauma or other injury, such as musculoskeletal illness, pain, fatigue, or inhibited circulation. Further, when a person's body is unsupported, the muscles around the joints and spinal bones may tire quickly due to constant strain and stress. The skeletal structure of the limbs and back of the human body has a difficult time maintaining an awkward or compressed posture at an improperly positioned workstation or an unsupported or uninsulated situation, such as concrete floor. The awkward posture can contribute to undesirable musculoskeletal discomfort and fatigue inhibited circulation (for example, resulting in tendonitis or arthritis), as well as reduced worker productivity and diminished quality and moral.

In an attempt to alleviate such occupational hazards, employers often place specialized, cushioned matting on floors proximate employee workstations. However, bunching and edge curling of the matting create tripping hazards in many settings, including occupational environments. Such hazards are a top recordable complaint in occupational settings. In some cases, the matting is taped to the floor around the periphery to reduce movement, resulting in extra man hours for installation and housekeeping concerns. Alternatively, the matting is glued to the floor making it a permanent one-time use product. Other mats are fastened to the floor via bolts or screws. However, the bolts and screws can be the cause of tripping hazards for personnel. Matting solutions are also restricted by hygiene, facilities, processes, surfaces, levels, and space.

Another problem with the floor matting is that the product is not a "one size fits all" product. The amount of support required by each person varies. Therefore, when two people work next to each other on one mat, the mat may not provide the needed support for both people.

Insertable cushioned insoles are commercially available to provide some additional support, as well as serve other functions, such as odor reduction. However, such insoles become compressed over time and do not take into account the weight of the person wearing them or the specific use to which they will be put.

Therefore, a need exists for a shoe, insole, and method of selection that allow an individual to choose a proper fitting shoe and/or insole based on the individual's physiology and optionally the intended use of the shoe or insole.

DETAILED DESCRIPTION OF A PREFERRED EMBODIMENT(S)

Figure 1:
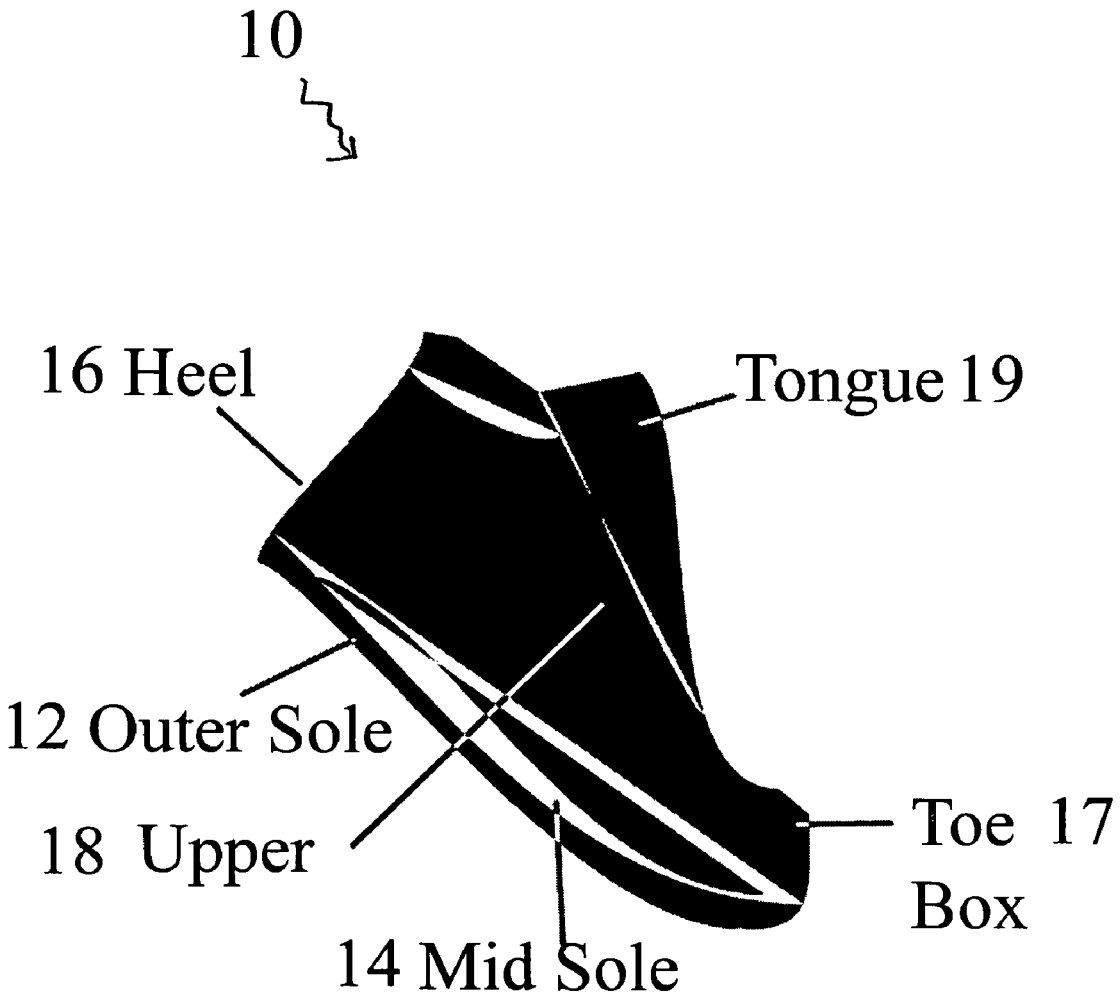
FIG. 1 is a plan diagram of a generic work shoe.

Generally, the present invention encompasses a shoe, insole, and method of selecting a shoe or insole that enable an individual to receive proper support based on the individual's physiology and optionally intended use of the shoe or insole. In accordance with the present invention, the individual, a salesperson, or any other applicable person determines a length of at least one foot (preferably both feet) of the individual, a weight of the individual, and a contact area of the bottom of the individual's foot or feet. The individual's weight is then divided by the contact area to yield an ergonomic interaction factor. A shoe or insole, as applicable, is then selected based at least on the length of the individual's foot and the ergonomic interaction factor. Alternatively, the intended use of the shoe (e.g., running, walking, standing at a workstation, etc.) is also taken into account when selecting the shoe or insole. In a preferred embodiment, the selected shoe or insole has an ergonomic interaction factor in the range of about 4 pounds per square inch (psi) to about 13 psi.

Running shoes and work shoes are known in the art. These shoes are designed with extra padding or support in known pressure points for the intended purpose. For example, a sneaker may be designed for a person who is known to pronate their feet while jogging. This sneaker will have extra support in the heel and upper to reduce pronation.

When a person is measured for a shoe, a determination of the length and width of the foot is made. However, none of the shoes available provide a necessary third measurement unique to the ergonomic needs of each individual.

Each person interacts with the ground in different ways. This is most evident at the beach, where footsteps can be seen in the sand. Some of the interaction is a function of the person's weight. Therefore, a child's foot will sink into the sand less than an adult's foot will, thereby leaving a lighter print. However, the interaction is also affected by the amount of the bottom of the foot area contacting the surface. So, when two people weigh the same amount, and one person has large feet and the other person has small feet, the footprints of the large-footed person will not be as deep as those of the small-footed person, even though they both weigh the same amount. This is because the large-footed person disperses their weight over a greater surface area. Even people of identical weight and identical foot size may exhibit different footprints because some people have high insteps and some people are flat-footed. The flat-footed person will have more surface area available with which to interact with the ground.

In addition, a person's activity also impacts the interaction. For example, when a person walks, their entire body weight is supported by one foot, and then the other. Effectively, there is a 50% reduction in contact area used to support body weight. When a person runs, the amount of contact area may be further reduced depending on their running style. Heel-to-toe runners place their entire weight on an area the size of their heel. Toe-to-heel runners place their entire weight on an area the size of their toes. The contact area available to support the entire body weight may be reduced to twenty to forty percent of the total foot surface area. Returning to the beach analogy, the interaction is evident for each of these activities. A runner's prints are much deeper than that of a walker. A walker's prints are deeper than those of a person just standing and watching the tide.

Ergonomics is the applied science of equipment design intended to maximize productivity by reducing operator fatigue, reducing cumulative trauma injury and discomfort. Ergonomics is also known as biotechnology, human engineering and human factors engineering. *The American Heritage Dictionary of the English Language, Fourth Edition*, (2000 by Houghton Mifflin Company). The intended purpose of the shoe is critical in choosing the shoe. While avid sports people have their sports shoes, the average public consumer uses one shoe for all purposes. So, if they plan on jogging three miles or standing to watch their child play sports, they will wear the same sneakers.

The present inventors have utilized this information to provide a new parameter useful in purchasing shoes. A person divides their weight, in pounds, by the contact area of the bottom of their feet, in squared inches. The result is referred to herein and in the appended claims as the "ergonomic interaction factor." A computer model, heat sensor, or scanning measurement of the feet may be used to obtain the exact contact area, or an approximation can be made by multiplying the length by the width. This number, as well as the intended purpose of the shoe, can be used to ensure that a shoe with the proper padding is obtained. In another embodiment and to facilitate practice of the present invention, a scale comprising a weight sensor and a contact area sensor is envisioned. A person would stand on the scale bare-foot and automatically obtain their ergonomic interaction factor. It is important for the person to be bare-foot, because socks or shoes may alter the contact area of their feet. In addition, the surface area of the scale may include removable, disposable layers for hygienic purposes.

Compression deflection and compression set are figures utilized by padding manufacturers to perform quality testing on their materials. In other words, padding manufacturers have developed standardized tests to ensure that each batch of padding is consistent with prior and future batches. Compression deflection, also known as compression resistance, is a measurement of the amount of force that will deform a material 25% and from which the material will return to its original shape. Similar to the ergonomic interaction factor, compression deflection is measured in pounds per square inch, or psi. Compression set is a measurement of the percentage of change exhibited by a material that has been compressed for twenty-four hours. Usually, the material is compressed fifty percent, also known as 50% compression set. After twenty-four hours, the compression force is released and the percent of set of the material is determined. The lower the number, the less set taken. For example, the height of a material is measured. A force is applied that compresses the material fifty percent for 24 hours. The force is released and the height of the material is measured. The new height is divided by the original height and multiplied by 100. This number is then subtracted from 100 to yield the compression set. Both of these measurements have standard test methods per the American Society for Testing and Materials (ASTM).

Based on their experience in the ergonomic, anti-fatigue matting industry, the present inventors have utilized the compression deflection and compression set factors to provide the necessary ergonomic support required by people in stationary or low-motion jobs. This experience evolved into the discovery of the ergonomic interaction factor. Using a person's newly determined ergonomic interaction factor (their weight divided by the contact area of the bottom of their feet), padding material can be varied to suit the intended purpose. For example, a person who weighs 200 lbs and has 50 squared inches of foot contact area on both feet exerts 4 pounds per square inch (psi) on the ground from merely standing. Therefore, they would require a padding exhibiting at least 4 psi compression deflection for stationary activities (200 lbs/50 $in^2$). This padding can take the form of the well-known stationary mats or can be incorporated in a shoe in the form of a stationary or insertable/removable insole. If that same person were to walk, they effectively remove half of the available contact area. This results in each foot exerting 8 psi (200 lbs/25 $in^2$). They, therefore, would require padding with a minimum of 8 psi compression deflection for walking activities. If this person has a job that requires a large amount of standing and no walking, the shoes that this person uses to walk should not be the same shoes that this person uses at work. If this person also jogs, their walking shoes should differ from their jogging shoes because they may exert up to 20 psi with each impact (200 lbs/10 $in^2$) and, therefore, require different padding. In an alternate embodiment, one shoe could be suitable for multiple activities (e.g., standing, walking and/or running) by inserting the appropriate insole into the shoe for the intended activity.

At the same time, the material should be able to bounce back after use. In other words, the material should exhibit low compression set. Interestingly, if the padding has the proper compression resistance for the intended purpose, compression set becomes less of an issue. If a person only exerts enough force to deflect the cushioning material 25%, they are not exerting the same amount of force that resulted in the compression set. The ASTM compression set method (D 1056) requires that the material be compressed 50%. Nonetheless, in choosing a material, the lower the compression set factor the better. For one reason, repetitive use may alter the material. We know this is true when we look at our own shoes and see the wear patterns. In addition, many people use one shoe for many purposes. Based on our example, if a person takes their stationary shoe that has 4 psi padding and goes jogging, they may subject the padding to forces as high as 20 psi. If the padding does not have sufficient compression set resistance, the person may have just ruined the support provided in their stationary shoes. Even if a person is diligent in using the proper shoe for the proper purpose, stuff happens. Perhaps one of their children or animals step on their feet, adding extra force, or, in a work environment, a hand truck may roll over or a box may land on a foot. By choosing a material with a low compression set resistance factor, both day-to-day life and human error can occur without affecting the shoes intended purpose.

A variety of materials are available to meet the needs of each person. Currently available, the inventors are familiar with open-cell and closed-cell products. However, any other materials exhibiting the desired properties may be used in the practice of the present invention. Both open-cell and closed-cell products are available in a large variety of compression deflection ranges. Preferably, the compression deflection range will be narrow to provide support tailored to each individual and their intended purpose. However, padding may still be capable of providing proper ergonomic support to both stationary and walking activities. In addition, alternate padding may be designed that supports both walking and running.

Open cell material looks and acts like a sponge. Closed cell material looks like a bunch of bubbles glued together. When force is applied to an open cell product, after release of the force, the product bounces back to shape because the open cell structure allows air to flow back into the material. On the contrary, when force is applied to a closed cell product, some of the bubbles may burst, resulting in a loss of cushion and support. The closed cell structure impedes the flow of air so that it does not return to its original shape as quickly after release of the force.

Open-cell foam products typically have lower compression set numbers. However, their structure permits the absorption of water, which may require them being sealed to prevent mold and mildew when utilized in the present invention. For example, Rubberlite Inc. offers a polyurethane open-cell product called HyPUR-cel® H0705 that may be used in the present invention. The product supports 3 to 7 psi and 3% maximum compression set. Rubberlite Inc. also offers closed-cell sponge rubber materials that may be used in the present invention. Two in particular, IV2 supports 5.0 to 9.0 psi and IV3 supports 9.0 to 13.0 psi. Both products exhibit 40% compression set. Armacell LLC offers a neoprene blend named IG-2 that supports 5 to 9 psi and 25% compression set. These materials are provided for exemplary purposes only and not intended to limit the scope of the present invention.

The present inventors recently discovered that some shoe manufacturers only utilize the compression set and shock attenuation properties of a padding material in shoe development. Shock attenuation is used to assess impact and rebound properties of a material. Some of the results provided by the shock attenuation test include peak acceleration, which is a measure of the rate of change in velocity (i.e., the slow down) as a cylinder hits a material, and energy return percent, which is the percentage of the peak velocity coming out divided by the velocity at impact. While these values may be important in analyzing running shoes, which experience repetitive impact, they are not as critical for works shoes and the like.

The inventors performed testing that compared the properties of two types of ergonomic matting with a variety of commercially available shoes, as well as the combination of the shoes and mats. The results, tabulated below, are the mean of ten test impacts.

| Test Material | Compression Deflection in psi (ASTM D 3574 Modified) | Shock Attenuation/ Peak Acceleration in G*s (ASTM F 1614) | Shock Attenuation/ % Energy Return (ASTM F 1614) |
|---|---|---|---|
| Mat 1 | 21.30 | 9.75 ± 0.06 | 43.86 ± 0.34 |
| Mat 2 | 17.65 | 11.84 ± 0.10 | 38.23 ± 0.47 |
| Shoe 1 Heel | 64.60 | 9.08 ± 0.08 | 42.25 ± 0.49 |
| Shoe 1 Ball | 61.27 | 11.19 ± 0.12 | 42.30 ± 0.36 |
| Shoe 1 Heel + Mat 1 | 63.15 | 6.76 ± 0.05 | 45.15 ± 0.55 |
| Shoe 1 Ball + Mat 1 | 46.95 | 7.23 ± 0.06 | 45.83 ± 0.76 |
| Shoe 1 Heel + Mat 2 | 65.17 | 7.13 ± 0.03 | 39.99 ± 0.34 |
| Shoe 1 Ball + Mat 2 | 46.90 | 7.50 ± 0.09 | 42.18 ± 0.42 |
| Shoe 2 Heel | 56.55 | 11.45 ± 0.10 | 42.78 ± 0.23 |
| Shoe 2 Ball | 73.95 | 16.57 ± 0.06 | 41.14 ± 0.13 |
| Shoe 2 Heel + Mat 1 | 53.20 | 8.09 ± 0.03 | 46.23 ± 0.55 |
| Shoe 2 Ball + Mat 1 | 69.60 | 8.91 ± 0.04 | 46.50 ± 0.41 |
| Shoe 2 Heel + Mat 2 | 58.83 | 8.52 ± 0.04 | 42.06 ± 0.42 |
| Shoe 2 Ball + Mat 2 | 66.78 | 9.26 ± 0.07 | 41.06 ± 0.50 |
| Shoe 3 Heel | 69.52 | 11.26 ± 0.04 | 45.17 ± 0.40 |
| Shoe 3 Ball | 30.25 | 17.04 ± 0.09 | 44.18 ± 0.22 |
| Shoe 3 Heel + Mat 1 | 82.83 | 7.95 ± 0.02 | 45.18 ± 0.40 |
| Shoe 3 Ball + Mat 1 | 59.05 | 9.26 ± 0.05 | 46.68 ± 0.46 |
| Shoe 3 Heel + Mat 2 | 73.08 | 8.11 ± 0.03 | 41.11 ± 0.38 |
| Shoe 3 Ball + Mat 2 | 49.45 | 9.76 ± 0.08 | 40.99 ± 0.32 |
| Shoe 4 Heel | 57.45 | 9.85 ± 0.04 | 49.09 ± 0.49 |
| Shoe 4 Ball | 54.60 | 13.66 ± 0.09 | 48.57 ± 0.50 |
| Shoe 4 Heel + Mat 1 | 75.37 | 7.64 ± 0.09 | 47.67 ± 0.53 |
| Shoe 4 Ball + Mat 1 | 67.80 | 8.27 ± 0.19 | 45.88 ± 0.66 |

-continued

| Test Material | Compression Deflection in psi (ASTM D 3574 Modified) | Shock Attenuation/ Peak Acceleration in G*s (ASTM F 1614) | Shock Attenuation/ % Energy Return (ASTM F 1614) |
|---|---|---|---|
| Shoe 4 Heel + Mat 2 | 68.02 | 8.04 ± 0.07 | 43.23 ± 0.20 |
| Shoe 4 Ball + Mat 2 | 65.62 | 8.85 ± 0.05 | 40.85 ± 0.20 |

*1 G=32 ft/sec.$^2$

Based on the foregoing test results, the compression deflection results for the mats alone are substantially less than the compression deflection results for the shoes alone or the shoes in combination with the mats. Moreover, none of the compression deflection results fall into the preferred range of Applicants' proposed ergonomic interaction factor. For example, the table below provides some of the possible ergonomic interaction factors for a variety of people. Obviously, a person with a high instep may have less contact area than a person with a flat foot, and therefore, even if the shoe size and weight below apply, a different ergonomic interaction factor may result.

| Men's Shoe Size | Contact Area | Weight | Ergonomic Interaction Factor |
|---|---|---|---|
| 12+ | 34.7 | 250+ | 7.2 |
| 11 | 31.8 | 225 | 7 |
| 10 | 28.9 | 200 | 6.9 |
| 9 | 26.2 | 175 | 6.7 |
| 8 | 23.1 | 150 | 6.5 |
| 7 | 20.2 | 125 | 6.2 |
| 6 | 17.3 | 100 | 5.8 |

The inventors have created and applied this new ergonomic interaction factor based on their experience in the ergonomic, anti-fatigue matting industry. However, even the compression deflection results for the mats (21.30, 17.65) are greater than the proposed ergonomic interaction factor for people (4-13). The higher compression deflection results for the mats and the shoes are a result of the various types of additional materials that are included in them. For example, ergonomic mats typically include a surface that minimizes risks in a work environment, such as non-conductive or insulating materials, electro-static discharge materials or any combination thereof. These materials impact the compression deflection test results for the entire mat. When a shoe is combined with the mat, the resulting compression deflection is affected by both the layers in the shoe and in the mat. The present invention adds an insole or compressible layer to existing shoes and includes the compression deflection properties of that material in the sizing information of the shoe. By enabling a person to correlate the compression deflection properties of a shoe or insole with his ergonomic interaction factor, the present invention removes the need for ergonomic matting.

FIG. 1 provides a generic diagram of a shoe 10. Most shoes contain a mid sole 14, an outer sole 12, a heel 16, an upper 18, a toe box 17 and a tongue 19. Either of these soles 12, 14 may extend the full length of the shoe 10 or be shortened, depending upon the intended purpose. The material of the present invention can be used in either of these locations. The mid sole 14 or the outer sole 12 can be made with the padding discussed. If open-cell foam is used, the top and/or bottom area will need to be sealed to prevent water absorption. As described earlier, open-cell foam requires some unsealed surfaces in order to properly breathe. Other occupational requirements, such as steel toes, non-slip soles, non-conductive or insulating material, electro-static discharge material or any combination thereof can also be accommodated by a shoe incorporating the padding of the present invention.

Figure 2:
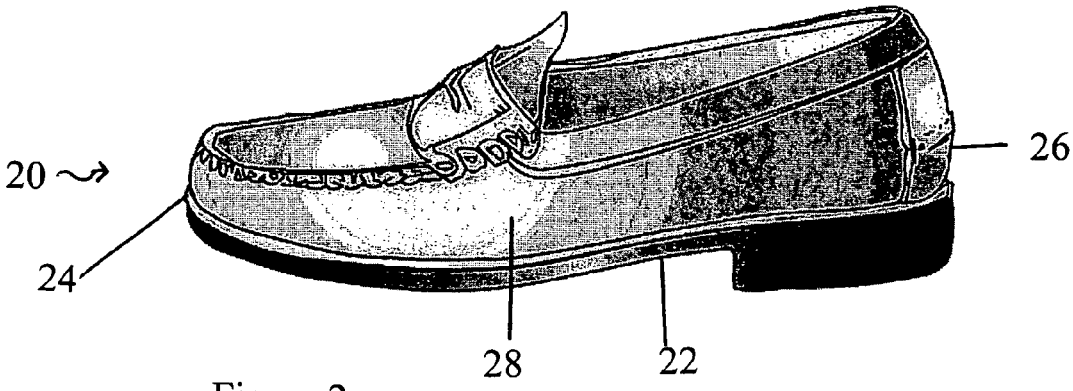
FIG. 2 is a perspective view of a generic shoe of the prior art.
Figure 3:
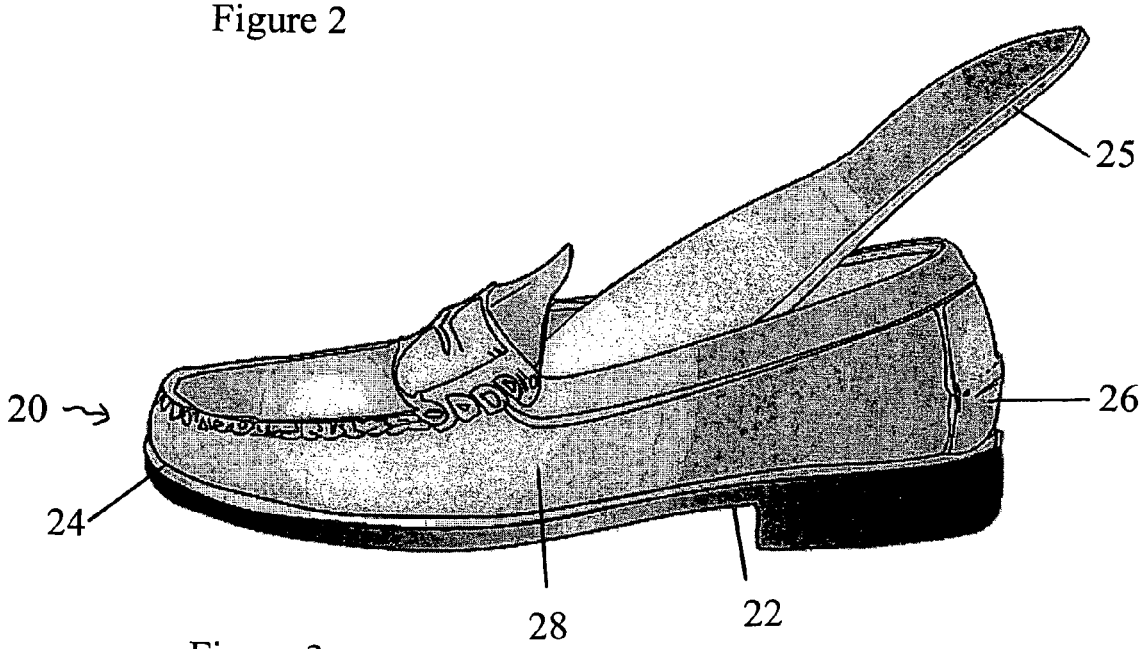
FIG. 3 is a perspective view of an insole according to the present invention being placed in the generic shoe of FIG. 2.

Another option is to provide an insole for use for an intended purpose. FIG. 2 provides a perspective view of a second generic shoe 20 found commonly in the prior art. In this example, the shoe 20 includes a mid sole 24, an outer sole 22, a heel 26, and an upper 28. FIG. 3 shows an insole 25 according to the present invention being placed into a generic shoe 20. A person could have one shoe 20 and two or three different insoles 25 that could be used depending on the person's intended activity and ergonomic interaction factor. The use of interchangeable insoles 25 provides the added benefit of extended shoe life. For example, a person who works on a manufacturing line is required to stand in one spot for long periods of time. Therefore, the outer portion of the shoe 20 experiences little wear and tear. However, the insole 25 of the shoe 20 is subject to large amounts of pressure and possibly even temperature, depending on the conditions. On a routine basis, the person can switch out the insole 25 to maintain the needed support and also to reduce odors caused by feet. This will be much less expensive than replacing the shoe 20.

The insole has the added benefit of being in direct contact with the foot. This means that no layers interfere with the interaction between the insole and the foot and, as a result, the foot experiences true ergonomic comfort.

In another embodiment, an "external insole" is envisioned. Rather than subject the padding to direct contact with the foot, the padding could be attached to the bottom of the shoe by any known or future created attachment mechanisms. Once again, the life of the shoe is extended and the comfort of the worker is maintained.

In another embodiment, the shoe may comprise multiple layers of different material. For example, an open cell material may comprise the top layer and provide a layer that bounces back after wear. Below this, a closed cell material may comprise a middle layer that absorbs higher impact action, or larger psi. The top layer provides the day-to-day support, but the middle layer cushions against the occasional extra force that may be encountered. Another example may provide the reverse layering for the same purpose; a closed cell top layer and an open cell middle layer. In another example, the wear patterns of a person's old shoes could be reviewed and a shoe with extra padding in those locations could be crafted.

Figure 4:
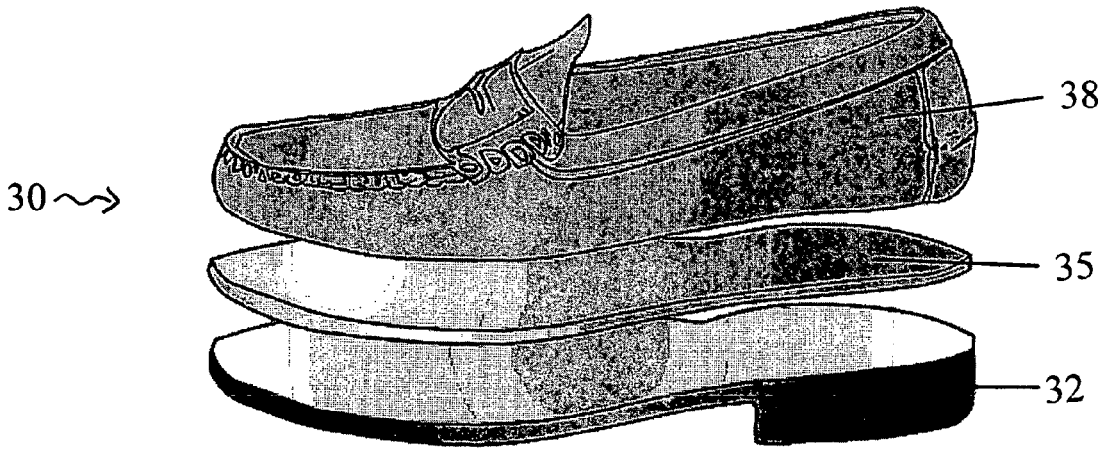
FIG. 4 is an exploded perspective view of the generic shoe of FIG. 2 incorporating one embodiment of the present invention.
Figure 5:
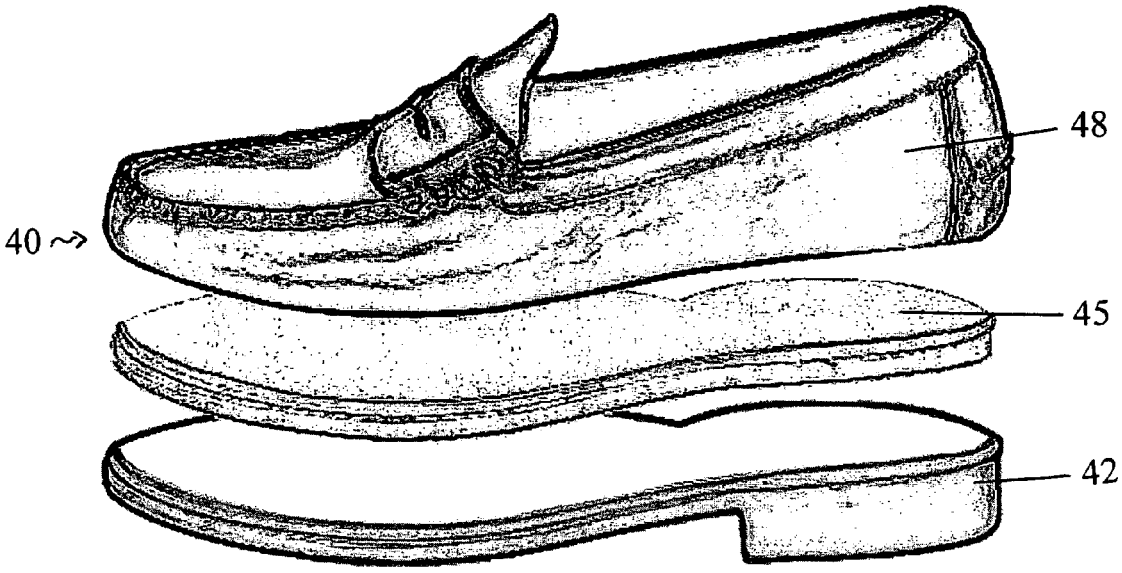
FIG. 5 is an exploded perspective view of the generic shoe of FIG. 2 incorporating an alternate embodiment of the present invention.

FIGS. 4 and 5 illustrate two examples of shoes 30, 40 incorporating multiple layers in the sole. The shoe 30 of FIG. 4 includes a single compressible layer 35 between the sole 32 and the upper 38. The shoe 40 of FIG. 5 includes a compressible layer 45, including multiple sub-layers, between the sole 42 and the upper 48. Either compressible layer 35, 45 may be made of one or more materials that provide the shoe 30, 40 with the proper range of compression deflection for its intended purpose. As discussed in previous paragraphs, a variety of materials are available for this purpose.

In addition, the bottom 31, 41 of the sole 32, 42 may include protrusions, abrasive surfaces, such as silica coating, or patterns such as diamond tread to improve traction in a work facility. The shoe 30, 40 may also include steel toes, non-conductive or insulating materials, electro-static discharge material or any combination thereof.

Tailoring each person's shoes or insoles to their intended purpose based on the proposed invention may allow employers to eliminate anti-fatigue matting and the safety and maintenance hazards associated therewith. Each employee will be more comfortable at their job, and therefore more productive, because their shoes provide the support their body needs.

EXAMPLE 1

Jane Smith is a nurse at the local hospital. She spends twelve hours on her feet per shift. The hospital requires specific shoes that do not properly support Jane's feet and she experiences much discomfort. Jane orders hospital shoes incorporating the present invention. The ergonomic padding provides the needed support to properly do her job. Her superiors commend her on her improved productivity.

EXAMPLE 2

A surgeon spends a large amount of time on his feet in one position performing surgeries. Due to his state's health code, he is not allowed to use an ergonomic mat. He purchases shoes incorporating the ergonomic interaction factor in psi that he needs to properly stand for long time periods. He finds that he is capable of operating an additional two hours with the new shoes.

The invention has been shown and described herein in the form of multiple embodiments with alternative features. It is to be understood, however, that the invention is not limited to the embodiments disclosed herein, and that the invention is intended to be limited only by the following claims.

We claim:

1. An insole for use in a shoe comprising at least one compressible padding consisting essentially of an open-cell material characterized by a maximum compression set of 3% as measured according to American Society for Testing and Materials (ASTM) test specification D1056 and a compression deflection up to 20 psi as measured according to American Society for Testing and Materials (ASTM) test specification D3574.

2. The insole of claim 1, wherein the compression deflection is in the range of about 3 psi to about 13 psi.

3. The insole of claim 1 wherein the compression deflection is selected from the group consisting of a range of from 3 to 7 psi, a range of from 5.0 to 9.0 psi, a range of from 9 to 13 psi, and combinations thereof.

4. The insole of claim 1 wherein the compression deflection is from 3 psi to 70 psi as measured according to American Society for Testing and Materials (ASTM) test specification D3574.

5. The insole of claim 1, further comprising additional compressible padding that consists of closed-cell material.

6. The insole of claim 5 wherein the closed-cell material is characterized by a compression set of about 25%.

7. The insole of claim 1 wherein the insole is selected in accordance with an 'ergonomic interaction factor' calculated by dividing a user's weight in pounds by the ground contact area of said user's feet in square inches.

8. The insole of claim 5 wherein the closed-cell material is characterized by a compression set of about 40%.

9. The insole of claim 1, including a shoe comprising a heel, a toe, an upper, an outer sole, and a tongue.

10. An insole for use in a shoe to be worn by a user, the insole comprising at least one multi-compressible layer including at least one compressible layer consisting of open-cell material characterized by a maximum compression set of 3% as measured according to American Society for Testing and Materials (ASTM) test specification D1056 and a compression deflection of up to 20 psi.

11. The insole of claim 10 wherein the at least one multi-compressible layer includes at least one compressible layer that consists of closed-cell material.

12. The insole of claim 11 wherein the closed-cell material is characterized by a compression set of about 25%.

13. The insole of claim 11 wherein the closed-cell material is characterized by a compression set of about 40%.

14. The insole of claim 11, wherein said at least one compressible layer consisting of open-cell material comprising said multi-compression layer is disposed on top of said at least one compressible layer consisting of closed-cell material.

15. The insole of claim 10 wherein the at least one multi-compressible layer includes at least one additional open-cell material a having different compression set value in the same layer.

16. The insole of claim 10 wherein the insole is removably insertable into the shoe.

17. The insole of claim 10 for use in a shoe comprising compressible padding that consists of said open-cell material selected from the group consisting of a range of from 3 to 7 psi, a range of from 5.0 to 9.0 psi, a range of from 9 to 13 psi, and combinations thereof.

18. The insole of claim 17 wherein the open-cell material is characterized by a maximum compression set of 3% as measured according to American Society for Testing and Materials (ASTM) test specification D1056.

19. The insole of claim 17, further comprising additional compressible padding that consists of closed-cell material.

20. The insole of claim 10 wherein the closed-cell material is characterized by a compression set of about 25%.

21. The insole of claim 10 wherein the closed-cell material is characterized by a compression set of about 40%.

22. The insole of claim 10, including a shoe comprising a heel, a toe, an upper, an outer sole, and a tongue.

23. An insole of comprising at least one compressible layer including open-cell material characterized by a maximum compression set of 3% as measured according to American Society for Testing and Materials (ASTM) test specification D1056 and a compression deflection up to 20 psi, and said at least one compressible layer including said open cell material having an ergonomic interaction factor ("EIF"), in the range of from 4 to 13 pounds per square inch based on determining the contact area of the bottom of a user's feet divided by the user's weight.

24. The insole of claim 23, wherein an ergonomic factor comprises a men's shoe size of said user elected from the group consisting of an EIF of 7.2 and shoe size of 12+, an EIF of 7 and shoe size of 11, an EIF of 6.9 and shoe size of 10, an EIF of 6.7 and shoe size of 9, an EIF of 6.5 and shoe size of 8, an EIF of 6.2 and EIF of 7, and an EIF of 5.8 and shoe size of 6.

* * * * *